US006793326B2

(12) United States Patent
Imamura et al.

(10) Patent No.: US 6,793,326 B2
(45) Date of Patent: Sep. 21, 2004

(54) FLOW PATH CONSTITUTING MEMBER FOR INK JET RECORDING HEAD, INK JET RECORDING HEAD HAVING FLOW PATH CONSTITUTING MEMBER AND METHOD FOR PRODUCING INK JET RECORDING HEAD

(75) Inventors: Isao Imamura, Kanagawa (JP); Akihiko Shimomura, Kanagawa (JP); Shigeru Mikami, Hyogo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/329,829

(22) Filed: Dec. 27, 2002

(65) Prior Publication Data

US 2003/0159287 A1 Aug. 28, 2003

(30) Foreign Application Priority Data

Dec. 28, 2001 (JP) ..... 2001-399337
Dec. 27, 2002 (JP) ..... 2002-379563

(51) Int. Cl.[7] ..... B41J 2/05
(52) U.S. Cl. ..... 347/65

(58) Field of Search ..... 347/65, 20, 54, 347/56, 63, 9, 5; 427/504, 510; 430/280.1; 522/40, 41, 33, 6, 1; 216/27

(56) References Cited

U.S. PATENT DOCUMENTS 6,455,112 B1 * 9/2002 Ohkuma et al.

* cited by examiner

*Primary Examiner*—Raquel Yvette Gordon
(74) *Attorney, Agent, or Firm*—Fitzpatrick, Cella, Harper & Scinto

(57) ABSTRACT

The invention provides a flow path constituting member for an ink jet recording head, having a low stress and a chemical resistance and capable of forming a coated film enabling easy pattern formation for example by an ultraviolet irradiation, an ink jet recording head utilizing such material, and a method for producing an ink jet recording head. For the flow path constituting member of the ink jet recording head, there is employed an epoxy resin composition including an epoxy resin having at least two epoxy groups within a molecule and a specified structure, and a cationic polymerization initiator.

8 Claims, 2 Drawing Sheets

FLOW PATH CONSTITUTING MEMBER FOR INK JET RECORDING HEAD, INK JET RECORDING HEAD HAVING FLOW PATH CONSTITUTING MEMBER AND METHOD FOR PRODUCING INK JET RECORDING HEAD

BACKGROUND OF THE INVENTION

1. Field of the Invention

The present invention relates to a flow path constituting member for an ink jet recording head, having a low stress and a chemical resistance and capable of forming a highly precise flow path by patterning for example by ultraviolet irradiation, an ink jet recording head including such flow path constituting member, and a method for producing an ink jet recording head.

2. Related Background Art

An ink jet recording head employed in an ink jet recording method (liquid discharge recording method) is generally provided with a plurality of constituting units, each including a small discharge port (also called orifice) for a recording liquid, a flow path communicating with the discharge port, and a liquid discharge energy generating unit provided in a part of the flow path. For obtaining an image of a high quality with such ink jet recording head, it is desirable that a small droplet of the recording liquid such as ink, to be discharged from the discharge port, is discharged from each discharge port always with a constant volume and a constant discharge speed. For achieving such state, Japanese Patent Applications Laid-open Nos. 4-10940 to 4-10942 disclose a method of applying a drive signal corresponding to recording information to an ink discharge pressure generating element (electrothermal converting element), thus causing the electrothermal converting element to generate thermal energy causing a rapid temperature increase in the ink to exceed a nucleus boiling thereof, thereby forming a bubble in the ink, and causing such bubble to communicate with the external atmosphere to discharge an ink droplet.

In an ink jet recording head realizing such method, a distance between the electrothermal converting element (heater) and the discharge port (orifice) is preferably as short as possible (such distance being hereinafter called "OH distance". In the aforementioned method, since the discharge volume is substantially determined by the OH distance, it is essential that the OH distance can be exactly and reproducibly selected.

Therefore, for producing an ink jet recording head having a highly precise OH distance, Japanese Patent Application Laid-open No. 6-286149 discloses a producing method for an ink jet recording head including (1) a step of forming an ink flow path pattern with a soluble resin, on a substrate on which an ink discharge pressure generating element is formed, (2) a step of dissolving a coating resin, containing an epoxy resin which is solid at the normal temperature, in a solvent and solvent coating such coating resin on the soluble resin layer thereby forming a covering resin layer constituting an ink flow path wall on the soluble resin layer, (3) a step of forming an ink discharge port in the covering resin layer above the ink discharge pressure generating element, and (4) a step of dissolving out the soluble resin.

For the resin employed in the method of the aforementioned patent specification, there is being employed a cationic polymerized product of an alicyclic epoxy resin in order to form a pattern of a high aspect ratio and to obtain an ink resistance.

However, the use of the cationic polymerized product of the alicyclic epoxy resin leads to following drawbacks.

The cationic polymerized product of the alicyclic epoxy resin, though being excellent in the adhesion force, shows a peeling in case of a high internal stress, because of a high mechanical strength.

Such drawback tends to occur particularly in case the head is made longer or the resinous composition becomes thicker.

SUMMARY OF THE INVENTION

An object of the present invention is to provide a flow path constituting material for an ink jet recording head, having a low stress and a chemical resistance and capable of forming a coated film enabling easily pattern formation for example by an ultraviolet irradiation, an ink jet recording head utilizing such material, and a method for producing an ink jet recording head.

The flow path constituting material of the present invention for the ink jet recording head is featured by an epoxy resin composition including an epoxy resin containing two or more epoxy groups within a molecule and a unit represented by a following general formula (1), and a compound selected from a cationic polymerization initiator, an amine and an acid anhydride:

(1)

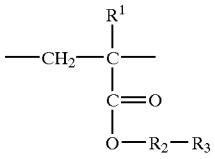

wherein $R^1$ represents —H or —$CH_3$; $R^2$ represents —$CH_2$—, —$(CH_2)_2$— or

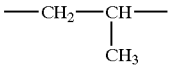

and $R^3$ represents

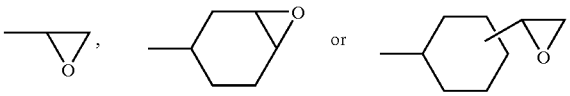

The ink jet recording head of the present invention is featured by including a flow path constituting member for the ink jet recording head of the above-mentioned configuration and a substrate on which an ink discharge pressure generating element is formed.

The method of the present invention for producing the ink jet recording head is featured by including (1) a step of forming an ink flow path pattern with a soluble resin, on a substrate on which an ink discharge pressure generating element is formed, (2) a step of dissolving a covering resin, formed by an epoxy resin composition including an epoxy resin containing two or more epoxy groups and a unit represented by a following general formula within a molecule, and a compound selected from a cationic polymerization initiator, an amine and an acid anhydride, in a solvent and solvent coating such covering resin on the soluble resin layer thereby forming a covering resin layer constituting an ink flow path wall on the soluble resin layer, (3) a step of forming an ink discharge port in the covering resin layer above the ink discharge pressure generating element, and (4) a step of dissolving out the soluble resin:

(1)

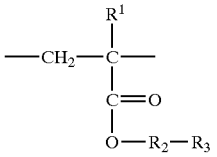

wherein $R^1$ represents —H or —$CH_3$; $R^2$ represents —$CH_2$—, —$(CH_2)_2$— or:

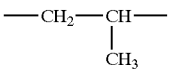

and $R^3$ represents:

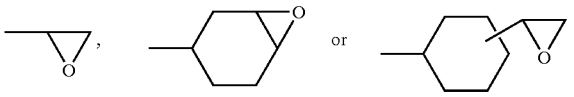

The use of such epoxy resin composition allows to obtain a covering resin layer capable of forming a flow path without surface irregularities which can cause ink trapping, and also to achieve a low stress and a chemical resistance, thereby enabling to produce an ink jet recording head improved in production yield and quality, with a significant decrease in drawbacks such as peeling.

DESCRIPTION OF THE PREFERRED EMBODIMENTS

Figure 1B:
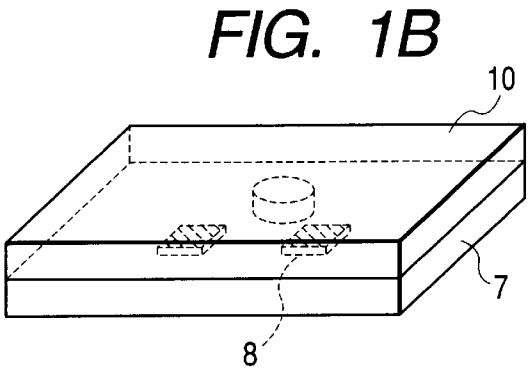
FIGS. 1A, 1B, 1C and 1D are views showing an example of process steps for forming an ink jet recording head.

In the epoxy resin composition of the present invention, there is employed an epoxy resin including at least two epoxy groups within a molecule and having a number-averaged molecular weight within a range of 1,000 to 20,000, preferably 2,000 to 10,000. For such epoxy resin, there can be advantageously employed a polyfunctional epoxy resin including a unit represented by a following general formula (1):

(1)

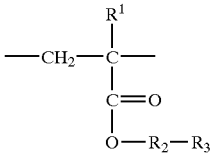

wherein $R^1$ represents —H or —$CH_3$; $R^2$ represents —$CH_2$—, —$(CH_2)_2$— or:

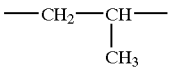

and $R^3$ represents:

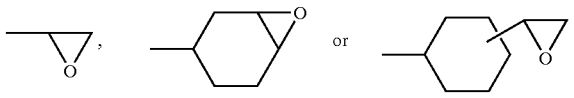

Such epoxy resin can be obtained, for example, by polymerizing an acrylic monomer, for introducing a unit having the above-mentioned epoxy group as a monomer unit into a polymer, by a method well known to those skilled in the art. In such polymerization, there may be employed an acrylic monomer without the epoxy group in combination, if necessary.

Such epoxy resin preferably has an epoxy equivalent amount of 2,000 or less, more preferably 1,000 or less, and a lower limit of such range is preferably 120. The epoxy equivalent amount within such range allows to effectively relax drawbacks such as a decrease in the crosslinking density at a curing reaction, leading to a loss in the glass transition point Tg of the thermal deformation temperature of the cured product or resulting in an insufficiency in adhesion or ink resistance.

The resin composition of the present invention is coated by a solvent coating method, and, because of this fact, the epoxy resin employed in the resin composition has a number-averaged molecular weight preferably within a range of 2,000 to 10,000.

In case the number averaged molecular weight is 3,000 or less, a satisfactory coated state can be secured by adding another resin which is solid at the normal temperature and has a high melting point.

After the resin composition of the present invention is dissolved as a solution in a solvent and coated on the substrate, it can be patterned by processes such as drying and heating, whereby a solid layer with a stable shape can be obtained.

In order to preferably form a flat surface (upper surface) of the covering resin layer, the epoxy resin is dissolved in the solvent in a concentration of 30 to 70 wt. %, more preferably 40 to 60 wt. % at the solvent coating.

Also in case of coating by a spin coating method, it is preferable to select the viscosity of the coating liquid within a range of 10 to 3000 cps, and to suitably select the solvent in such a manner that the coating liquid containing the epoxy resin has a desired viscosity at the above-mentioned concentration.

The epoxy resin composition of the present invention has advantages of having an excellent chemical resistance and an excellent adhesion to various members, and having an excellent patterning property because of a high sensitivity to light. Also it can provide a cured substance excellent as a structural member and having a low curing stress.

The epoxy resin composition of the present invention contains a polymerization initiator for initiating polymerization of the epoxy resin. For such polymerization initiator, there is employed a cationic polymerization catalyst (initiator). Such cationic polymerization initiator can be, for example, a photopolymerization initiator or a thermal polymerization initiator.

In case of employing a photopolymerization initiator, a selective patternwise surface treatment can be realized by employing an onium salt of a Lewis acid which is activated by an active energy ray as a catalyst. An increase in the molecular weight of the epoxy resin reduces the resolution, but such change can be compensated by an addition of another resin or by an alignment of the molecular weight, and the sensitivity can be improved by an increase of the molecular weight. A patternwise surface treatment can be realized by coating a resin composition on the substrate, then executing irradiation of an active energy ray through a mask and executing a development process with a developing solution. The basic process in such case is similar to that in the photolithography, but it is necessary to select a solvent or a solvent composition suitable for the resin composition as the developing solution. As the developing solution, there can be employed an aromatic hydrocarbon, a ketone, an ester, a glycol ether or a mixture thereof.

The epoxy resin composition of the present invention is preferably so designed as to have a higher reactivity to an onium salt of a Lewis acid which is activated by an active energy ray particularly enabling curing at a low temperature, in order to easily achieve a processing by photolithography. Examples of a photopolymerization initiator preferred for such designing include an aromatic iodonium salt such as bis(4-tert-butylphenyl) iodonium salt, an aromatic sulfonium salt [cf. J. Polymer Sci.: Symposium No.56383-395 (1976)], Optomer SP-150 and Optomer SP-170 (manufactured by Asahi Denka Co., Ltd.), and Irgacure 261 (manufactured by Ciba Specialty Inc.):

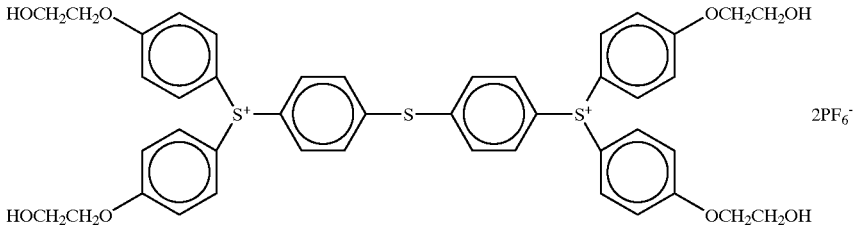

Optomer SP-150

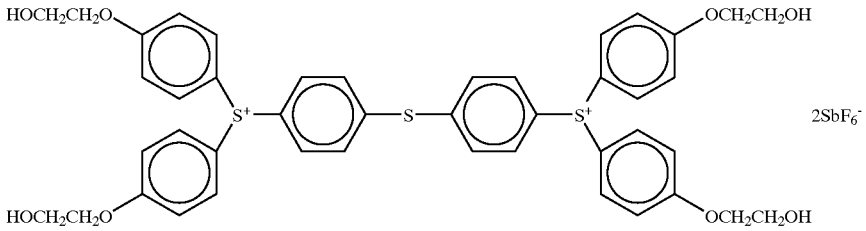

Optomer SP-170

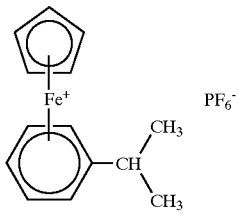

Irgacure 261

The thermal polymerization initiator can be, for example, a cationic thermal polymerization initiator such as Adeka Opton CP-66 (manufactured by Asahi Denka Co., Ltd.) or Adeka Opton CP-77 (manufactured by Asahi Denka Co., Ltd.), and such initiator allows to polymerize and cure the epoxy resin by heating.

The use of a cationic polymerization initiator in the epoxy resin composition is preferred because a cationic polymerized substance of the epoxy resin has a relatively high crosslinking density (high Tg) and shows excellent characteristics as a structural material. Also depending on the characteristics required for the cured substance, there may also be employed an ordinary epoxy curing agent such as an amine or an acid anhydride, the presence of which also enables curing by heating. Also in case of curing by heating, there may be added an accelerator such as a tertiary amine or imidazole according to the necessity.

In a thermal curing system employing a thermal cationic polymerization initiator or an ordinary epoxy curing agent, it is possible to obtain an ink jet recording head by thermally curing a coated film after the formation thereof, and forming a discharge port in the obtained cured film by a process with an excimer laser or by dry etching. In case of employing a thermal polymerization initiator, an amount thereof can be so selected as to obtain a desired curing state of polymerization, and can be selected according to the normal method.

The epoxy resin composition of the present invention can be obtained by mixing the epoxy resin and the polymerization initiator described in the foregoing. The epoxy resin composition of the present invention may be adjusted in resin concentration or in viscosity for example with a solvent, according to the type of the process for forming the flow path wall of the ink jet recording head. Examples of such solvent include methyl ethyl ketone (MEK), methyl isobutyl ketone (MIBK), diglyme, xylene, toluene, cyclohexane and methyl lactate.

An amount of the photopolymerization initiator with respect to the epoxy resin is so selected as to obtain desired polymerization characteristics, and is preferably within a range from 0.5 to 10 parts by weight with respect to 100 parts by weight of the epoxy resin.

In case of employing a cationic photopolymerization initiator, a reducing agent may be used in combination and the resin composition may be heated to further accelerate the cationic polymerization (with an increase in the crosslinking density in comparison with a simple cationic photopolymerization). However, in case of employing a cationic photopolymerization initiator and a reducing agent in combination, the reducing agent has to be so selected as to obtain a initiator system of so-called redox type which does not induce reaction at the normal temperature but reacts above a certain temperature (preferably 60° C. or higher). For such reducing agent, there is preferred a copper compound, particularly a copper trifluorate (copper (II) trifluoromethane sulfonate), in consideration of reactivity and mutual solubility with the epoxy resin. Other reducing agents such as ascorbic acid are also useful. Also in case a higher crosslinking density (higher Tg) is required for increasing the number of the orifices (for a higher printing speed) or for using a non-neutral ink (for improving water resistance of a coloring agent), the above-described reducing agent may be used as a solution, after the developing step of the covering resin layer, in a post step of impregnating and heating the coating resin layer as will be explained later, thereby increasing the crosslinking density.

Also the epoxy resin composition may be suitably added with various additives according to the necessity. For example, it is possible to add a flexibility providing agent in order to reduce the elastic modulus of the epoxy resin, or to add a silane coupling agent in order to increase the adhesive force with the substrate.

In the following there will be explained with reference to the drawings an example of a method for producing an ink jet recording head, utilizing the epoxy resin composition of the present invention.

Figure 1D:
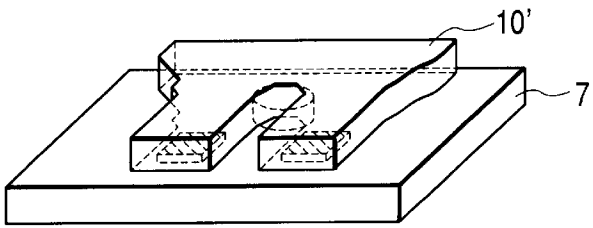
Figure 1A:
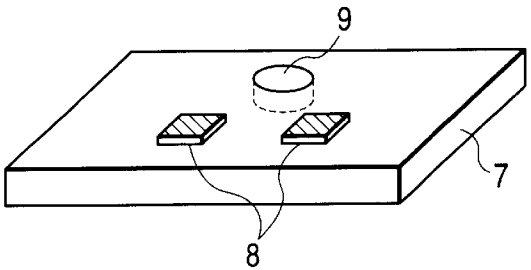

At first a substrate 7 composed of glass, ceramics, plastics or a metal as shown in FIG. 1A is employed, and an ink discharge energy generating element 8 such as an electrothermal converting element or a piezoelectric element is provided thereon in a desired number of units. The substrate 7 is not particularly limited in the shape or the material thereof, as long as it can function as a part of the flow path constituting member and as a support member for a material layer for forming an ink flow path and an ink discharge port to be explained later. Such ink discharge energy generating element 8 provides the ink with a discharge energy for discharging an ink droplet, thereby discharging an ink droplet from the discharge port onto a recording medium such as recording paper thereby forming a record thereon.

In case the ink discharge energy generating element 8 is formed by an electrothermal converting element, such element heats the ink in the vicinity, thereby inducing a state change therein and generating a discharge energy. Also in case of using a piezoelectric element, such element executes a mechanical vibration to generate a discharge energy.

Such element 8 is connected with control signal entering electrodes (not shown) for driving such element. Also, there are generally provided various functional layers such as a protective layer for improving the durability of such discharge energy generating element, but the presence of such functional layers is quite acceptable.

FIG. 1A illustrates a configuration in which the substrate 7 is provided in advance with an ink supply aperture 9 and the ink is supplied from the back of the substrate 7. For forming the aperture 9, there may be employed any method capable of forming a hole in the substrate 7. For example, there may be utilized mechanical means such as a drill, or an optical energy such as of a laser. It is also possible to utilize a chemical etching, by forming a resist pattern on the substrate 7.

It is naturally possible also to form the ink supply aperture 9 not in the substrate 7 but in a covering resin layer 12 to be explained later, namely in a same layer as an ink discharge port 14 with respect to the substrate 7.

Then, as shown in FIG. 1B, a layer 10 for forming an ink flow path pattern 10' is formed with a soluble resin, on the substrate 7 bearing the ink discharge energy generating element 8. The layer 10 can be most commonly formed with a photosensitive material, but it can also be formed for example by screen printing. As the ink flow path pattern 10' is required to be soluble, there can be employed a positive-working resist or a negative-working resist with a variable solubility in case of using a photosensitive material.

Figure 1C:
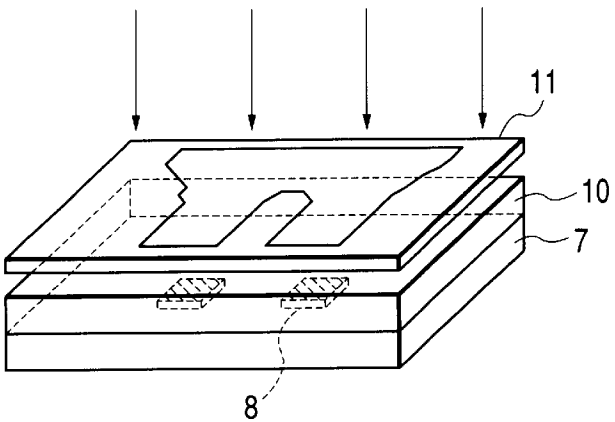

For forming the layer 10, in case of using the substrate 7 having the ink supply aperture 9 as shown in FIG. 1A, it is preferred to dissolve the photosensitive material in a suitable solvent, to coat and dry an obtained solution on a film such as a PET film to form a dry film, and to transfer such dry film by lamination onto a necessary portion on the substrate 7. For such dry film, there can be advantageously employed a photodegradable polymer compound such as polymethylisopropenyl ketone or polyvinyl ketone. Such compound can be employed because it retains a property as a polymer (film forming property) prior to a light irradiation and can be easily laminated on the ink supply aperture 9. The layer 10 can also be formed by a spin coating method or a roller coating method in ordinary manner, after the ink supply aperture 9 is closed by a filling material that can be eliminated in a post process. The layer 10 can be patterned as shown in FIGS. 1C and 1D, for example by a photolithographic process, to obtain the ink flow path pattern 10'.

Figure 2B:
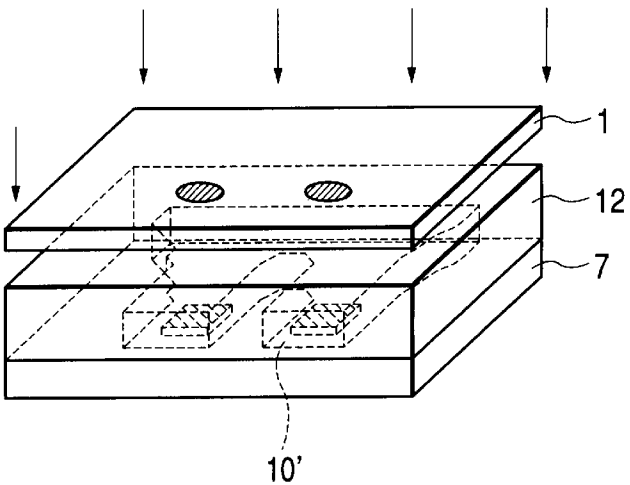
FIGS. 2A, 2B and 2C are views showing an example of process steps for forming an ink jet recording head.
Figure 2A:
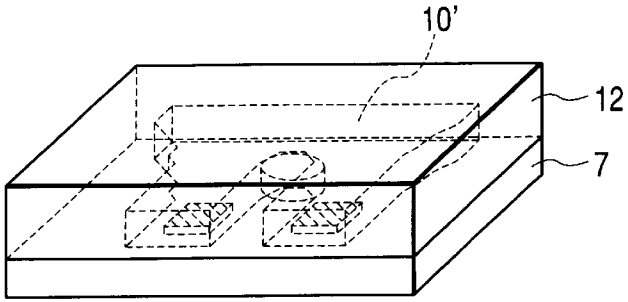

On thus formed ink flow path pattern 10', a covering resin layer 12 is formed as shown in FIG. 2A, by a spin coating method or a roller coating method in ordinary manner. In the step of forming the covering resin layer 12, there is required means for avoiding a deformation in the ink flow path pattern 10'. More specifically, in the operations of dissolving the material for constituting the covering resin layer 12 in a solvent to obtain a coating liquid and coating such coating liquid on the ink flow path pattern 10' by a spin coating method or a roller coating method, the solvent of the coating liquid has to be so selected as not to dissolve the ink flow path pattern 10'.

In the following there will be given an explanation on the covering resin layer 12. The covering resin layer 12 is preferably photosensitive in view of forming easily and precisely an ink discharge port 14 by a photolithographic process. For such covering resin layer 12, there are required a high mechanical strength as a structural material, a high adhesion to the substrate 7, an ink resistance etc. and a resolution for forming a fine pattern of the ink discharge port 14. It is also required to form a layer of a cured substance attaining an even lower stress and an improved chemical resistance. The epoxy resin composition of the present invention meets these requirements and is extremely suitable as the flow path constituting material for the ink jet recording head. The cationic polymerized substance of epoxy resin shows excellent properties as a structural material, as it has a higher crosslinking density (higher Tg) in comparison with an ordinary cured substance obtained with an acid anhydride or an amine. Also in case of employing a photopolymerization initiator, the use of the epoxy resin which is solid at the normal temperature allows to suppress diffusion of polymerization initiating species, generated from the cationic polymerization initiator under light irradiation, into the epoxy resin layer, thereby providing excellent precision and shape of patterning. In addition to these characteristics of the epoxy resin, the epoxy resin composition of the present invention can achieve a further reduction in the stress and an improvement in the chemical resistance.

For the step of forming the covering resin layer 12 on the ink flow path pattern 10', there is preferred a method of dissolving an epoxy resin, which is solid at the normal temperature and is capable of forming the covering resin layer, in a solvent together with the polymerization initiator, and forming the covering resin layer by a spin coating method. The spin coating method, which is a thin film coating technology, allows to uniformly and precisely form the covering resin layer 12, and to shorten the distance from the ink discharge energy generating element 8 to the discharge port, thereby easily achieving discharge of a small ink droplet from the discharge port 14.

The covering resin layer 12, so formed as to cover the ink flow path pattern 10', is preferably so formed as to have a flat surface. In case the surface, constituting a face including the discharge port, has irregularities, recesses therein constitute unnecessary ink traps when the layer is used as a product. A formation of a flat surface can avoid formation of such recesses and also facilitates the work for forming the ink discharge port in the covering resin layer 12.

In the following there will be explained a case where the covering resin layer is formed with a photosensitive epoxy resin composition. The photosensitive covering resin layer 12 is subjected to a patternwise exposure through a mask 1 as shown in FIG. 2B. In case the covering resin layer 12 is negative working, a portion where the ink discharge port 14 is to be formed is shielded by the mask (a portion for electrical connection being naturally shielded also, though not being illustrated). The patternwise exposure can be made with a radiation suitably selected from an ultraviolet light, a deep-ultraviolet light, an electron beam, an X-ray etc. according to a photosensitive region of the cationic photopolymerization initiator to be used.

Steps up to this stage can be executed under an alignment utilizing the known photolithographic technology, so that the precision can be significantly improved in comparison with a method of preparing an orifice plate separately and adhering it to the substrate. The patternwise exposed covering resin layer 12 may be subjected to a heating, if necessary, in order to accelerate the reaction. Since the covering resin layer 12 is formed as a layer which is solid at the normal temperature and is capable of patterning, the diffusion of the cationic polymerization initiating species generated by the patternwise exposure is restricted in the layer, whereby excellent precision and shape of patterning can be realized.

Figure 2C:
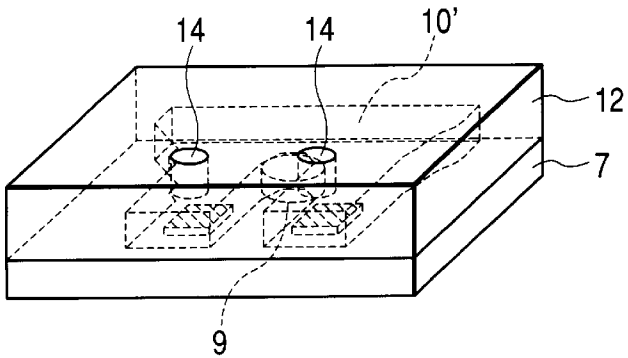

Subsequently, the photosensitive covering resin layer 12 subjected to the patternwise exposure is developed with a suitable solvent to form an ink discharge port 14 as shown in FIG. 2C. At the developing operation for the unexposed portion of the covering resin layer 12, it is possible to simultaneously develop the ink flow path pattern 10' formed by the soluble material. However, since plural heads of same or different configurations are generally provided on the substrate 7 and an ink jet recording head is prepared through a cutting step of mutually separating such plural heads, it is also possible, in order to avoid dust in such cutting step, to at first selectively develop the covering resin layer 12 only, thereby leaving the ink flow path pattern 10' undeveloped (dust generated in the cutting step do not enter the liquid chamber because the ink flow path pattern 10' remains therein), and to develop the ink flow path pattern 10' after the cutting step. Also scum (developing residue) generated at the development of the covering resin layer 12 can be dissolved out together with the soluble ink flow path pattern 10' and does not remain in the ink flow path or in the discharge port.

In case it is required to increase the crosslinking density in the cured substance of the epoxy resin composition constituting the covering resin layer 12, there can be utilized, as explained in the foregoing, a process of post curing by immersing and heating the cured covering resin layer 12, in which the ink flow path and the ink discharge port are formed, in a solution containing a reducing agent. Such process further increases the crosslinking density of the covering resin layer 12, thereby providing an adhesion to the substrate and an ink resistance of a very satisfactory level. This process of immersing in the copper ion-containing solution and heating may naturally be executed immediately after the formation of the ink discharge port by patternwise exposure and development of the covering resin layer 12, and the dissolution of the soluble resin pattern may be executed thereafter. Also the steps of immersion and heating may be executed by heating during the immersion or by heating after the immersion.

In case the photocurable epoxy resin composition is of negative working type, there may result a reflection from the substrate surface and a scum (development residue). However, in case of the illustrated process, the reflection from the substrate surface can be disregarded as the pattern of the discharge port 14 is formed on the ink flow path pattern 10' of the soluble resin, and the scum developed at the development has not detrimental effect since it can be lifted off in the aforementioned step of forming the ink flow path by washing off the soluble resin.

A laminate member including the substrate with thus formed ink flow path and ink discharge port is subjected to certain necessary processes to complete an ink jet recording head. As such process, there may be applied an ink repellent process on the face including the ink discharge port, in order to further effectively avoiding a deflection of the ink droplet or a failure in the discharge thereof, resulting from an ink trapping on such face. The ink repellent treatment in such case can be achieved, for example, by a method of forming a water repellent layer, for example by a transfer method, on the face including the discharge port.

A following experiment was executed in order to confirm an internal stress of the resin after curing.

The confirmation of the internal stress was executed by observing a film thickness of the resin prior to curing and that after curing, and, if both film thicknesses are same, the internal stress resulting from a volume change associated with the curing of the resin can be considered extremely small.

A composition shown in Table 1 and a composition shown in Table 2 were respectively spin coated on 6-inch wafers in such a manner as to obtain a film thickness of 19.5 $\mu$m after a prebake for 5 minutes at 95° C. on a hot plate, then exposed with a dose of 1 J/cm$^2$ by an exposure equipment MPA600, postbaked for 4 minutes at 90° C. on a hot plate, and cured for 1 hour at 200° C.

TABLE 1

| (Composition of epoxy resin composition 1) | |
|---|---|
| alicyclic epoxy resin of general formula (2) (Mn = 5000) | 100 parts by weight |
| epoxy silane coupling agent A-187 (trade name; Nippon Unicar) | 5 parts by weight |
| SP-170 (trade name; Asahi Denka Co.) | 2 parts by weight |
| diethyleneglycol dimethyl ether | 100 parts by weight |

(2)

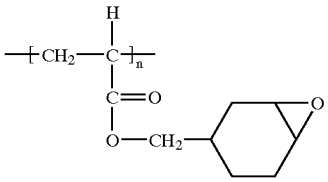

(n = 23 to 29)

TABLE 2

| (Epoxy resin composition 2) | |
|---|---|
| EHPE-3150 (trade name; Daicel Chemical Industries Co., Ltd.; Mn = 1070) | 100 parts by weight |
| A-187 (trade name; Nippon Unicar Co.) | 5 parts by weight |
| Optomer SP-170 (trade name; Asahi Denka Co.) | 2 parts by weight |
| diethyleneglycol dimethyl ether | 100 parts by weight |

In a measurement of film thickness after curing for 1 hour at 200° C., a decrease in the film thickness was not observed in the composition shown in Table 1 but was observed in the composition shown in Tab. 2.

Also a stress after curing, measured with a thin film stress measuring apparatus FLX-2320 manufactured by Tencole Co., was $8.5\times10^7$ dyne/cm$^2$ in Table 1, and $2.0\times10^8$ dyne/cm$^2$ in Table 2.

These results confirmed that the stress in the composition of Table 1, representing the material of the present invention was significantly lower than that in the composition of Table 2, representing a conventional material.

In the following, the present invention will be further clarified by examples.

EXAMPLE 1

An ink jet recording head was prepared with the process shown in FIGS. 1A to 1D and FIGS. 2A to 2C. A Si substrate provided with an ink supply aperture was employed as the substrate 7, then an electrothermal converting element as the discharge energy genereating element was formed in a predetermined position, and a necessary portion of the surface of the substrate was covered by a protective layer. In a predetermined part of the surface of the substrate 7 bearing the discharge energy generating element 8, a layer 10 of a positive photoresist ODUR1010 (trade name, manufactured by Tokyo Oka Co.) was formed with a thickness of 14 $\mu$m.

Then the layer 10 was exposed to light through a mask 11 excluding a portion where a flow path is to be formed and a portion where a liquid chamber communicating therewith is to be formed, and was developed with a predetermined developing solution to obtain an ink flow path pattern 10'. On a predetermined part of the surface bearing the ink flow path pattern 10', a flow path constituting material of a following composition (epoxy resin composition 1) was so spin coated as to obtain a film thickness of 30 $\mu$m, and was baked for 3 minutes at 90° C. on a hot plate to obtain a covering resin layer 12.

Then, the covering resin layer 12 was exposed, excluding a part of a discharge port 14, to an ultraviolet light with an intensity of 5 J/cm$^2$ through a mask 1, then baked for 4 minutes at 80° C. on a hot plate and was developed with xylene, whereby the covering resin layer 12 was cured and the discharge port 14 was formed. Then, after irradiation with a deep UV light, the resist ODUR1010 constituting the pattern was removed with MIBK, and baking was conducted for 1 hour at 200° C. to obtain an ink jet recording head of 3 inches. The completed ink jet recording head was subjected to an immersion test in a black ink for a printer BJF8500 (trade name, manufactured by Canon Inc.) for 1 week at 60° C. but the recording head obtained in the present example did not show any change such as peeling.

EXAMPLE 2

An ink jet recording head was prepared in the same manner as in Example 1 except that an epoxy resin composition 3 of a following composition was employed in forming the covering resin layer 12, and was subjected to an immersion test in ink. As a result, the recording head obtained in the present example also did not show any change such as peeling.

TABLE 3

| (Epoxy resin composition 3) | |
|---|---|
| Alicyclic epoxy compound of general formula (3) (Mn = 2000) | 70 parts by weight |
| EHPE-3150 (trade name; Daicel Chemical Industries Co., Ltd.; Mn = 1070) | 30 parts by weight |
| A-187 (trade name; Nippon Unicar Co.) | 5 parts by weight |
| SP-170 (trade name; Asahi Denka Co.) | 2 parts by weight |
| diethyleneglycol dimethyl ether | 100 parts by weight |

(3)

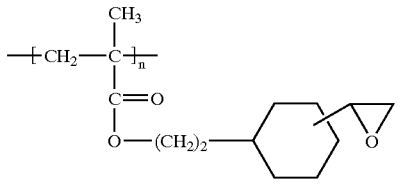

(n = 9 to 13)

COMPARATIVE EXAMPLE 1

An ink jet recording head was prepared in the same manner as in Example 1 except that the aforementioned epoxy resin composition 2 was employed in forming the covering resin layer 12, and was subjected to an immersion test in ink. As a result, the recording head obtained in the present comparative example showed, after the immersion in the ink, a peeling in a part of the flow path member, presumably induced by a stress resulting from curing.

COMPARATIVE EXAMPLE 2

An ink jet recording head was prepared in the same manner as in Example 1 except that the an epoxy resin composition 4 of a following composition was employed in forming the covering resin layer 12, and was subjected to an immersion test in ink. As a result, the recording head obtained in the present comparative example showed, after the immersion in the ink, a peeling in a part of the flow path member, presumably induced by a stress resulting from curing.

TABLE 4

| (Epoxy resin composition 4) | |
|---|---|
| EPPN 201 (trade name; manufactured by Nippon Kayaku Co.; Mn = 1090) | 100 parts by weight |
| A-187 (trade name; Nippon Unicar Co.) | 5 parts by weight |
| Optomer SP-170 (trade name; Asahi Denka Co.) | 2 parts by weight |
| diethyleneglycol dimethyl ether | 100 parts by weight |

1-inch recording heads were prepared with the aforementioned samples with a film thickness of 50 $\mu$m. In the observation after the head preparation, the member of the present example showed satisfactory patterning precision, without any peeling, but the member of the comparative example showed peeling in a part.

What is claimed is:

1. A flow path constituting member for an ink jet recording head, formed by an epoxy resin composition including an epoxy resin containing two or more epoxy groups and a unit represented by the following general formula (1) within a molecule, and a compound selected from a cationic polymerization initiator, an amine and an acid anhydride:

(1)

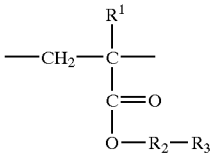

wherein $R^1$ represents —H or —$CH_3$, $R^2$ represents —$CH_2$—, —$(CH_2)_2$— or:

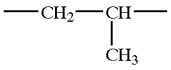

and $R^3$ represents:

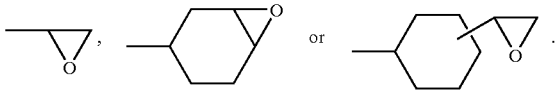

2. A flow path constituting member for an ink jet recording head according to claim 1, wherein said epoxy resin has a number-averaged molecular weight within a range from 2,000 to 10,000.

3. A flow path constituting member for an ink jet recording head according to claim 1, wherein said epoxy resin composition is subjected to patterning.

4. An ink jet recording head comprising a flow path constituting member for an ink jet recording head according to claim 1, and a substrate on which an ink discharge pressure generating element is provided.

5. An ink jet recording head comprising a flow path constituting member for an ink jet recording head according to claim 2, and a substrate on which an ink discharge pressure generating element is provided.

6. An ink jet recording head comprising a flow path constituting member for an ink jet recording head according to claim 3, and a substrate on which an ink discharge pressure generating element is provided.

7. A method for producing an ink jet recording head comprising the following steps, performed on a substrate on which an ink discharge pressure generating element is provided:

1) forming an ink flow path pattern with a soluble resin layer;
2) dissolving, in a solvent, a covering resin formed by an epoxy resin composition including an epoxy resin containing two or more epoxy groups and a unit represented by the following general formula (1) within a molecule, and a compound selected from a cationic polymerization initiator, an amine and an acid anhydride, and solvent coating such covering resin on the soluble resin layer, thereby forming a covering resin layer constituting an ink flow path wall on the soluble resin layer;
3) forming an ink discharge port in the covering resin layer above the ink discharge pressure generating element; and
4) dissolving out the soluble resin layer:

(1)

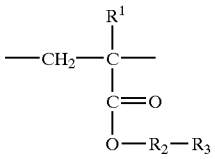

wherein $R^1$ represents —H or —$CH_3$; $R^2$ represents —$CH_2$—, —$(CH_2)_2$— or:

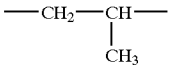

and $R^3$ represents:

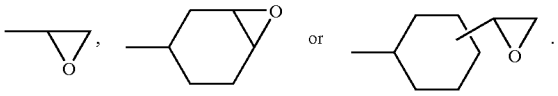

8. A method for producing an ink jet recording head according to claim 7, wherein the ink discharge port is formed by a photolithographic method.

* * * * *